US008157424B2

(12) United States Patent
Zhang et al.

(10) Patent No.: US 8,157,424 B2
(45) Date of Patent: Apr. 17, 2012

(54) LAMP HOLDER

(75) Inventors: Jianmin Zhang, Greer, SC (US); Jesse Sanchez, Jr., Mansfield, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 13/025,359

(22) Filed: Feb. 11, 2011

(65) Prior Publication Data

US 2012/0033435 A1 Feb. 9, 2012

Related U.S. Application Data

(63) Continuation of application No. 12/235,694, filed on Sep. 23, 2008, now Pat. No. 7,909,488.

(51) Int. Cl.
*F21V 21/00* (2006.01)

(52) U.S. Cl. ..... 362/371; 362/370

(58) Field of Classification Search ..... 362/368, 362/370, 371
See application file for complete search history.

(56) References Cited

U.S. PATENT DOCUMENTS

| | | | |
|---|---|---|---|
| 4,657,372 | A | 4/1987 | Ikeda et al. |
| 4,887,133 | A | 12/1989 | Ikeda et al. |
| 2010/0007394 | A1 | 1/2010 | Hsueh et al. |

*Primary Examiner* — David V Bruce

(57) ABSTRACT

A lamp holder comprising a lamp holder base, a lamp holder housing and a microswitch. In a preferred embodiment, the lamp holder base has a longitudinal axis and an actuator finger coupled to and shielded within the lamp holder base. The lamp holder housing is removably coupleable to the lamp holder base, and the microswitch is mounted within the lamp holder housing, wherein the microswitch is activated by the actuator finger when the lamp holder housing is inserted into and rotated with respect to the lamp holder base.

25 Claims, 6 Drawing Sheets

FIG. 3
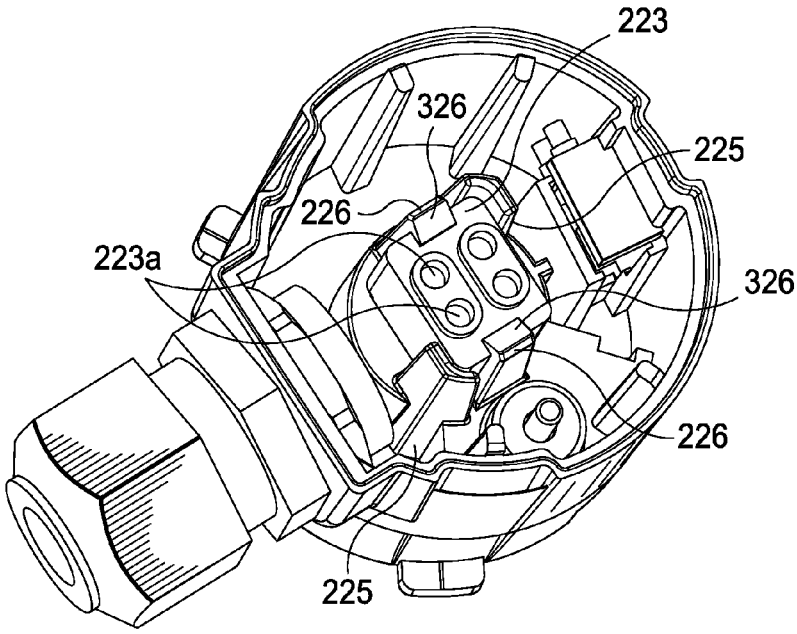
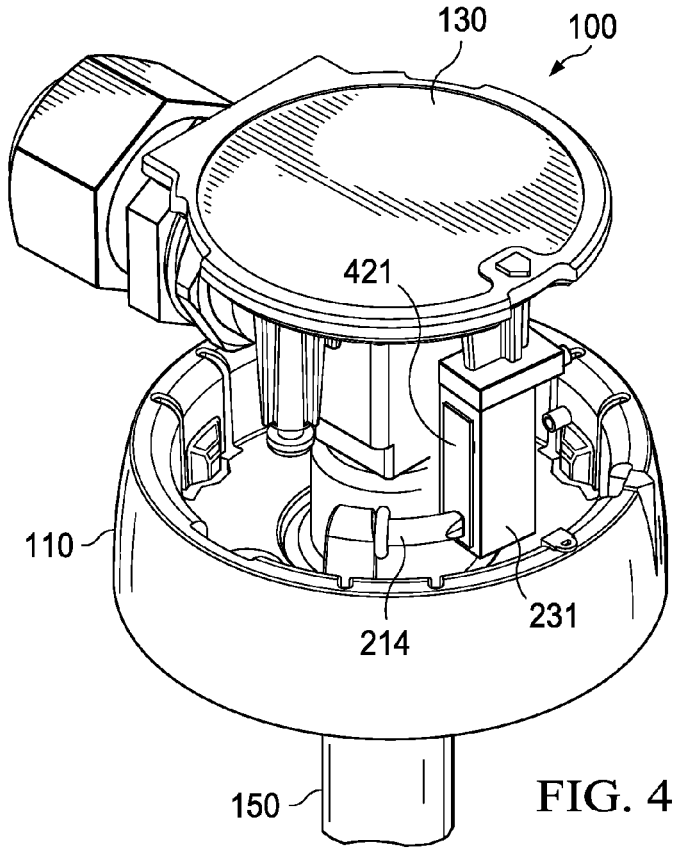
FIG. 4

LAMP HOLDER

CROSS REFERENCE RELATED APPLICATION

This application is a continuation of U.S. application Ser. No. 12/235,694 filed on Sep. 23, 2008, entitled "LAMP HOLDER", commonly assigned with the present invention and incorporated herein by reference.

TECHNICAL FIELD OF THE INVENTION

The present invention is directed, in general, to an ultraviolet lamp holder and, more specifically, to an ultraviolet C-band lamp holder.

BACKGROUND OF THE INVENTION

Air conditioning systems sometimes play an unintended role as a source of pathogenic microorganisms. Under certain conditions frequently common in the evaporator section of an air conditioning system, mold can grow on the evaporator coil and drain pan surfaces, thereby affecting overall air quality. As a viable method to control the microbial growth, Ultra-Violet Germicidal Radiation (UVGR) sterilization has gained public acceptance. More specifically, ultraviolet C-band (UVC) radiation within the evaporator assembly provided by a UVC lamp improves air quality and maintains system efficiency by keeping the evaporator mold-free.

However, UVC can cause eye injury and therefore must be carefully integrated with the evaporator assembly. To prevent such injury, a safety interlock mechanism is often integrated with UVC lamp units preventing illumination of the lamp unless it is completely installed in its intended position. One system relies upon a spring biasing a switch depressing lever away from the switch when the mounting assembly is not installed in a proper aperture of a duct. This can be defeated readily by installing a UV lamp into the mounting assembly, and then depressing an exposed portion of the switch depressing lever. Another approach is similar with a mounting base that must be in contact with the duct to energize the electrical circuit. It appears that this interlock could be defeated in much the same way as the previous art because it only requires contact with a "depressing surface."

Accordingly, what is needed in the art is a more positive interlock that prevents electrical circuit activation when the lamp holder is not installed in the base.

SUMMARY OF THE INVENTION

To address the above-discussed deficiencies of the prior art, the present invention provides a lamp holder comprising a lamp holder base, a lamp holder housing and a microswitch. In a preferred embodiment, the lamp holder base has a longitudinal axis and an actuator finger coupled to and shielded within the lamp holder base. The lamp holder housing is removably coupleable to the lamp holder base, and the microswitch is mounted within the lamp holder housing, wherein the microswitch is activated by the actuator finger when the lamp holder housing is inserted into and rotated with respect to the lamp holder base.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which:

FIG. 3 illustrates a closeup view of the lamp socket, guiding posts and holding clips;

FIG. 4 illustrates a perspective view of the lamp holder 100 with the lamp holder housing removed for clarity of the internal operation of the lamp holder;

DETAILED DESCRIPTION

Figure 1:
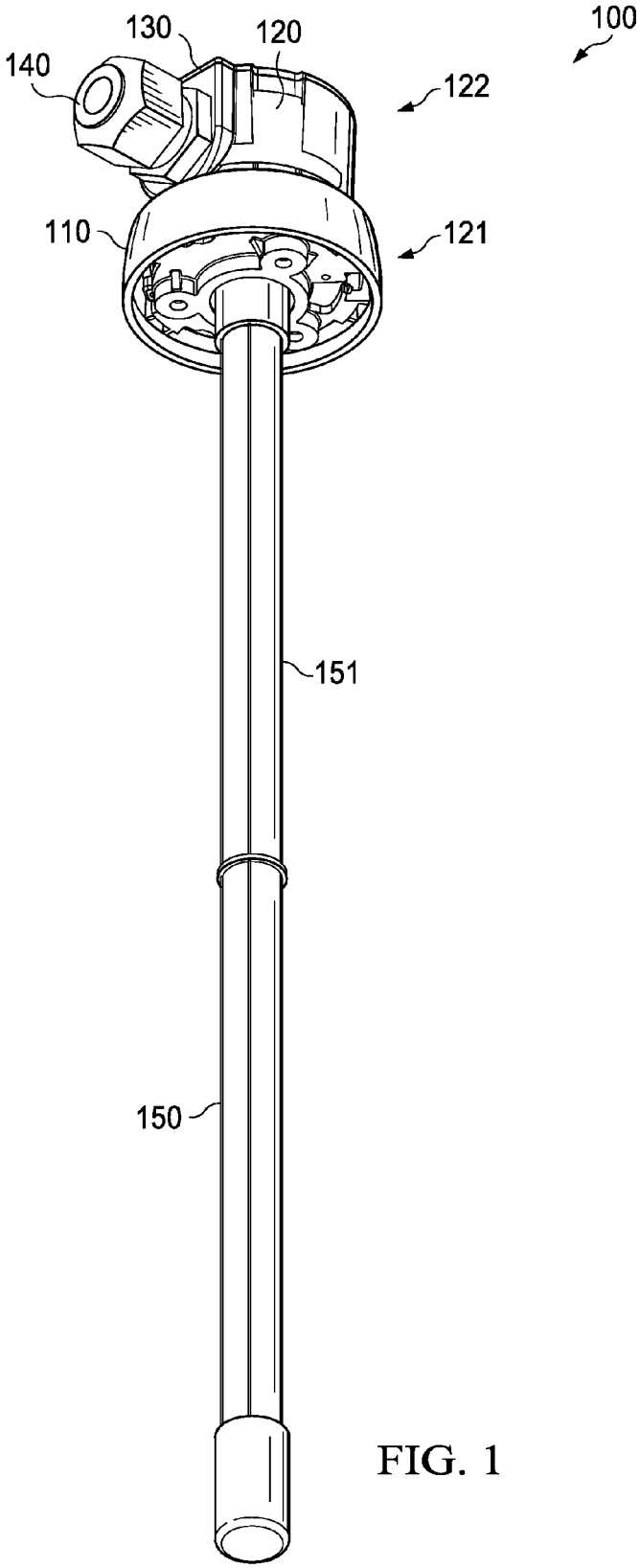
FIG. 1 illustrates a perspective view of one embodiment of a lamp holder constructed according to the principles of the present invention.

Referring initially to FIG. 1, illustrated is a perspective view of one embodiment of a lamp holder 100 constructed according to the principles of the present invention. The lamp holder 100 comprises a lamp holder base 110, a lamp holder housing 120, a cap 130, and a power cable fitting 140. The lamp holder 100 holds a lamp 150 having a lamp shield 151. In a preferred embodiment, the lamp 150 is an ultraviolet C-band lamp. In the illustrated embodiment, the lamp holder housing 120 has first and second ends 121, 122 respectively. The lamp holder base 110, lamp holder housing 120 and cap 130 may be made of any suitable material such as molded plastic, etc. One who is of skill in the art will readily ascertain other suitable materials.

Figure 2A:
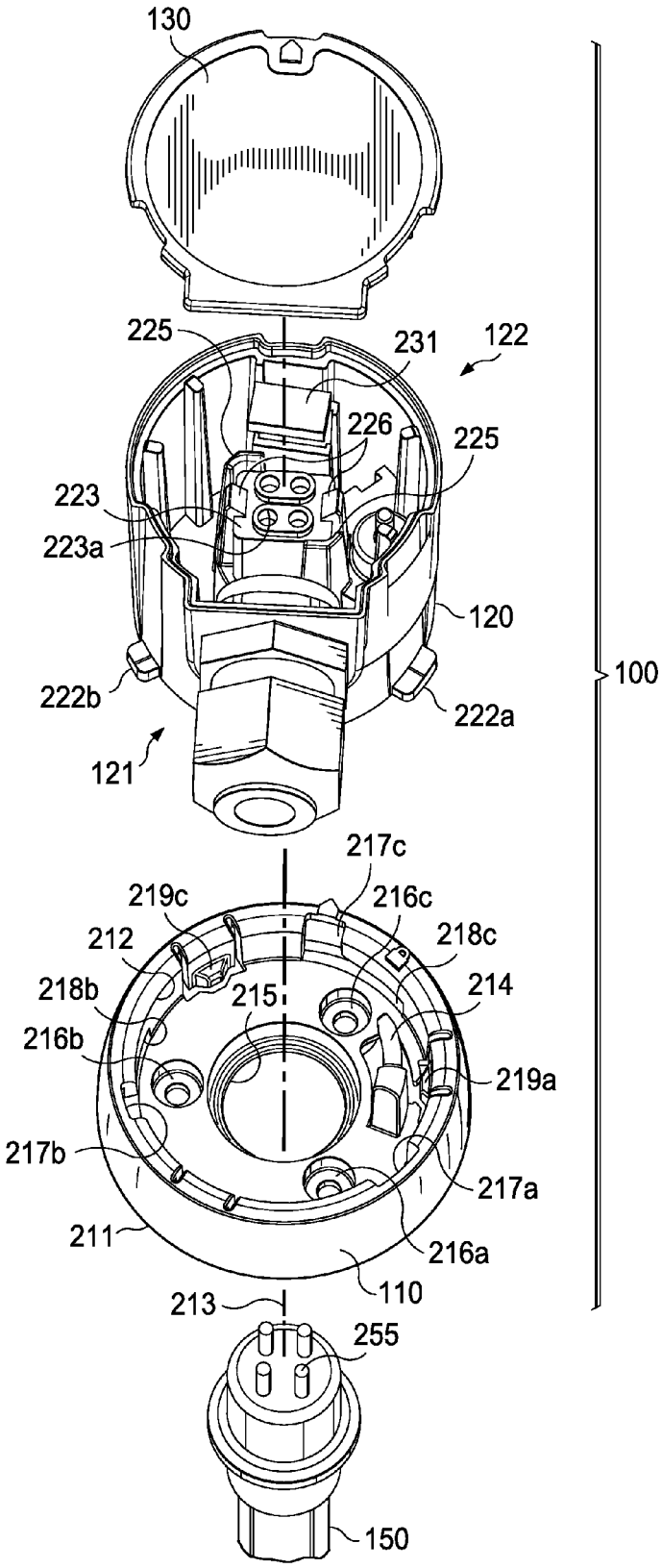
FIG. 2A illustrates an exploded top perspective views of the lamp holder of FIG. 1.
Figure 2B:
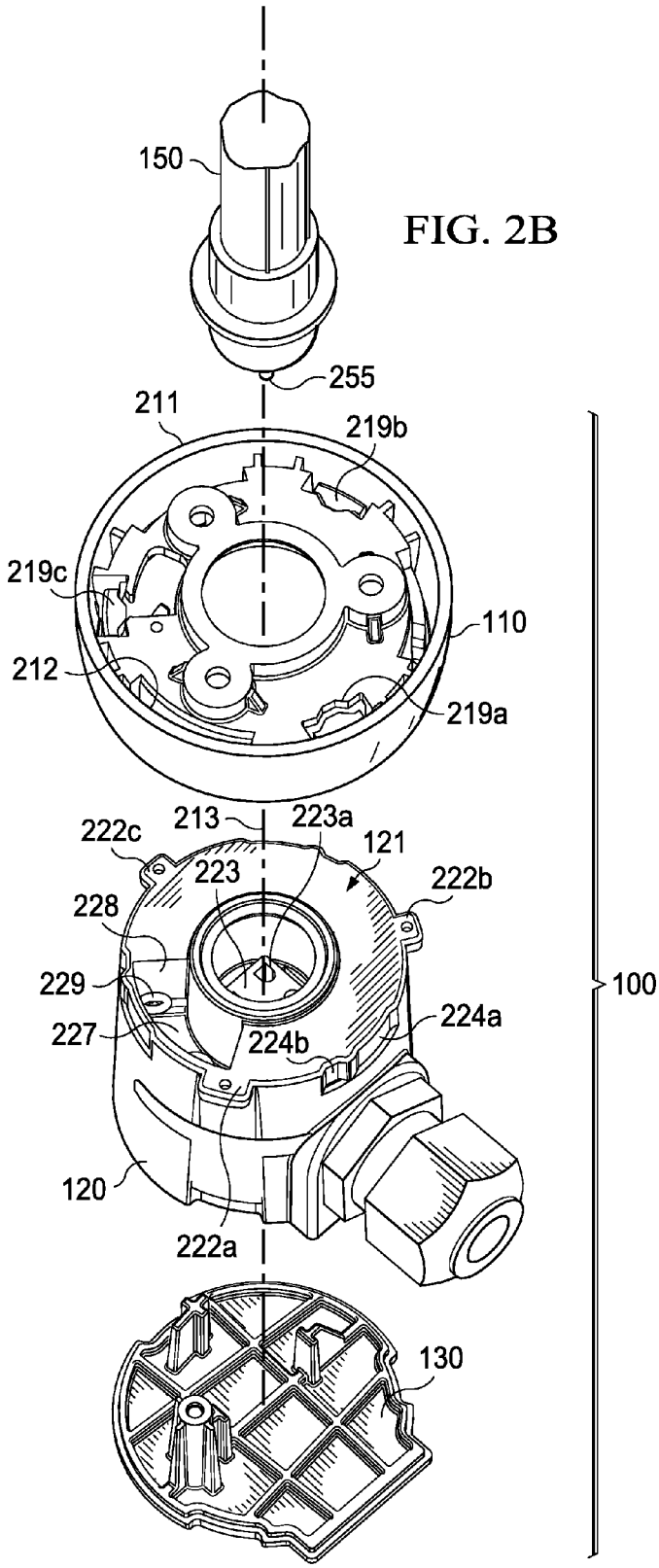
FIG. 2B illustrates an exploded bottom perspective views of the lamp holder of FIG. 1.

Referring now to FIGS. 2A and 2B, illustrated are exploded top and bottom perspective views, respectively, of the lamp holder 100 of FIG. 1. The lamp holder base 110 is formed as a shallow cup having an outer wall 211 and an inner wall 212 around a longitudinal axis 213. The longitudinal axis 213 is common to the lamp 150, the lamp holder base 110, the lamp holder housing 120 and the cap 130. The lamp holder base 110 comprises an arcuate actuator finger 214, a central aperture 215, a plurality of mounting apertures 216*a*-216*c*, a plurality of longitudinal notches 217*a*-217*c*, a plurality of arcuate grooves 218*a*-218*c*, and a plurality of deflectable tabs 219*a*-219*c*. Note that not all numbered elements may be visible in the figures. The arcuate actuator finger 214 is coupled to the lamp holder base 110 and is at least partially shielded from access by a technician by the outer wall 211.

The mounting apertures 216*a*-216*c* enable the lamp holder base 110 to be mounted to a suitable surface of a heat exchanger (not shown).

The lamp holder housing 120 comprises a plurality of alignment lugs 222*a*-222*c*, a lamp socket 223, and a microswitch 231. The plurality of alignment lugs 222*a*-222*c* extends radially outward from the longitudinal axis 213 proximate the first end 121. The plurality of longitudinal notches 217*a*-217*c* cooperate with the plurality of alignment lugs 222*a*-222*c* when the lamp holder housing 120 is inserted into the lamp holder base 110. The plurality of arcuate grooves 218*a*-218*c* cooperate with the alignment lugs 222*a*-222*c* when the lamp holder housing 120 is rotated in the lamp holder base 110. NOTE: The lamp 150 is shown in the FIGURES on the bottom side of the lamp holder base 110 for clarity and brevity of the FIGURES. However, the lamp 150 is actually inserted through the first end 121 of the lamp holder housing 120 and pins 255 connect to contacts 223*a* of the lamp socket 223. The lamp 150 is then inserted through central aperture 215 and the lamp holder housing 120 is removably coupled to the lamp holder base 110 by inserting the lamp holder housing 120 into the lamp holder base 110 and rotating the lamp holder housing 120 clockwise with respect to the lamp holder base 110 as will be described more fully below. Note that alignment lug 222*a* is wider than alignment lugs 222*b*-222*c* and that longitudinal notch 217*a* is wider than longitudinal notches 217*b*-217*c*. This assures that the lamp holder housing 120 can only be inserted into the lamp holder base 110 in its correct alignment with the lamp holder base 110.

The lamp holder 100 incorporates a twist-lock mechanism comprising a plurality of deflectable tabs 219*a*-219*c* on the inner wall 212 of the lamp holder base 110 and first and second detents 224*a*, 224*b*, respectively, in a periphery of the lamp holder housing 120 proximate the first end 121. The deflectable tabs 219*a*-219*c* and the first and second detents 224*a*, 224*b* cooperate to lock the lamp holder housing 120 to the lamp holder base 110 against inadvertent separation.

Affixed to the lamp holder housing 120 at the second end 122 is the non-removable cap 130. The lamp socket 223 is removably coupleable to the lamp holder housing 120 when inserted between guiding posts 225 and secured by holding clips 226. The guiding posts 225 are configured to guide the lamp socket 223 into a lamp-receiving position as shown in FIG. 2A, and the holding clips 226 are configured to resist movement of the lamp socket 223 from the lamp-receiving position. The lamp 150 is coupleable to the back side (see FIG. 2B) of the lamp socket 223 and extends through the central aperture 215 in the lamp holder base 110.

The first end 121 of the lamp holder housing 120 has an arcuate well 227 therein. The arcuate well 227 is configured to cooperate with the arcuate actuator finger 214 when the lamp holder housing 120 is inserted into the lamp holder base 110. The arcuate well 227 has a radial wall 228 and an aperture 229 therethrough. The aperture 229 is configured to permit passage of at least a portion of the arcuate actuator finger 214 through the radial wall 228 when the lamp holder housing 120 is rotated clockwise with respect to the lamp holder base 110.

Referring now to FIG. 3, illustrated is a closeup view of the lamp socket 223, guiding posts 225 and holding clips 226. The lamp socket 223 is assembled to the lamp holder housing 120 by inserting the lamp socket 223 between the guiding posts 225 and pushing the lamp socket 223 longitudinally against beveled surfaces 326 of the holding clips 226 until the holding clips 226 spread apart enough to receive the lamp socket 223. The holding clips 226 them spring back to grasp the lamp socket 223 in the lamp-receiving position as shown.

Referring now to FIG. 4, illustrated is a perspective view of the lamp holder 100 with the lamp holder housing 120 removed for clarity of the internal operation of the lamp holder 100. In this FIGURE, it can be seen that the arcuate actuator finger 214 is positioned to depress a lever 421 of the microswitch 231 when the lamp holder housing 120 (FIG. 1) is rotated clockwise with respect to the lamp holder base 110. Depressing the lever 421 energizes the circuit that powers the lamp 150. It should be clear that the internal location of the microswitch 231 is such that it is obscured from access by a technician or others who might attempt to energize the power circuit of the lamp 150 in such a way as to endanger the technician or others. The cap 130 being permanently affixed to the lamp holder housing 120 prevents access to the microswitch 231.

Figure 5:
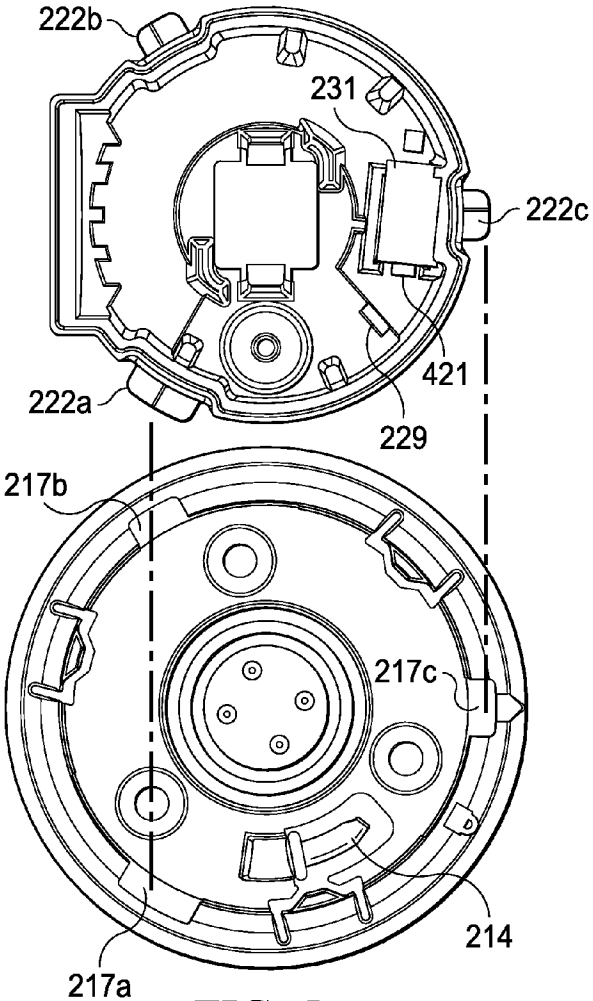
FIG. 5 illustrates a partial exploded top view of the lamp holder base and the lamp holder housing registered one to the other as the lamp holder housing would be inserted into the lamp holder base.

Referring now to FIG. 5, illustrated is a partial exploded top view of the lamp holder base 110 and the lamp holder housing 120 registered one to the other as the lamp holder housing 120 would be inserted into the lamp holder base 110. Note that the oversize alignment lug 222*a* aligns with the wider longitudinal notch 217*a* while alignment lugs 222*b*-222*c* align with longitudinal notches 217*b*-217*c*, respectively. The arcuate actuator finger 214 will cooperate with the aperture 229 to allow the arcuate actuator finger 214 to depress the lever 421 of the microswitch 231 when the lamp holder housing 120 is rotated CW in the lamp holder housing 110.

Figure 6A:
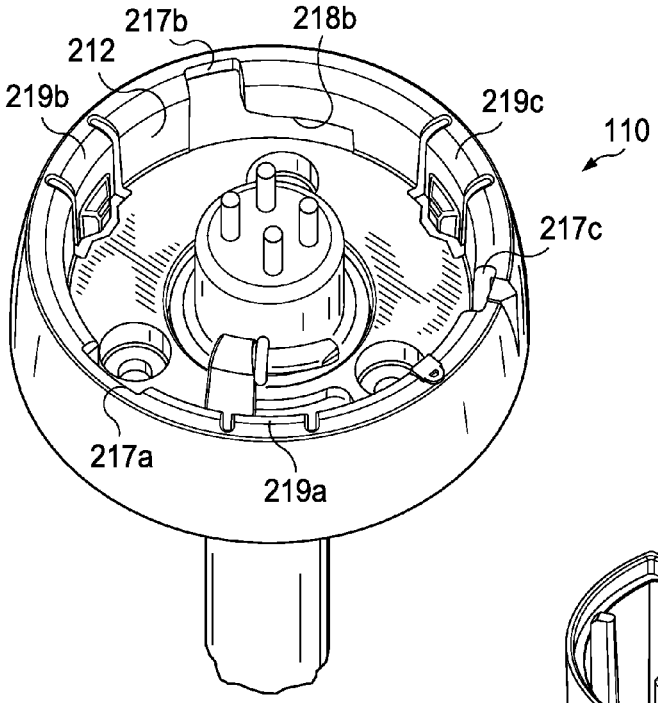
FIG. 6A illustrates a top view of the lamp holder base to show the deflectable tabs on the inner wall of the lamp holder base and one of the arcuate grooves in the inner wall.

Referring now to FIG. 6A, illustrated is a top view of the lamp holder base 110 to show the deflectable tabs 219*a*-219*c* on the inner wall 212 of the lamp holder base 110 and one of the arcuate grooves 218*b* in the inner wall 212. The remaining arcuate grooves 218*a*, 218*c* are not visible in this view but are similar in size and shape. One who is of skill in the art will readily recognize how the alignment lugs 222*a*-222*c* cooperate with the longitudinal notches 217*a*-217*c* when the lamp holder housing 120 is inserted into the lamp holder base 110; and how the alignment lugs 222*a*-222*c* cooperate with the plurality of arcuate grooves 218*a*-218*c* when the lamp holder housing 120 is rotated in the lamp holder base 110.

Figure 6B:
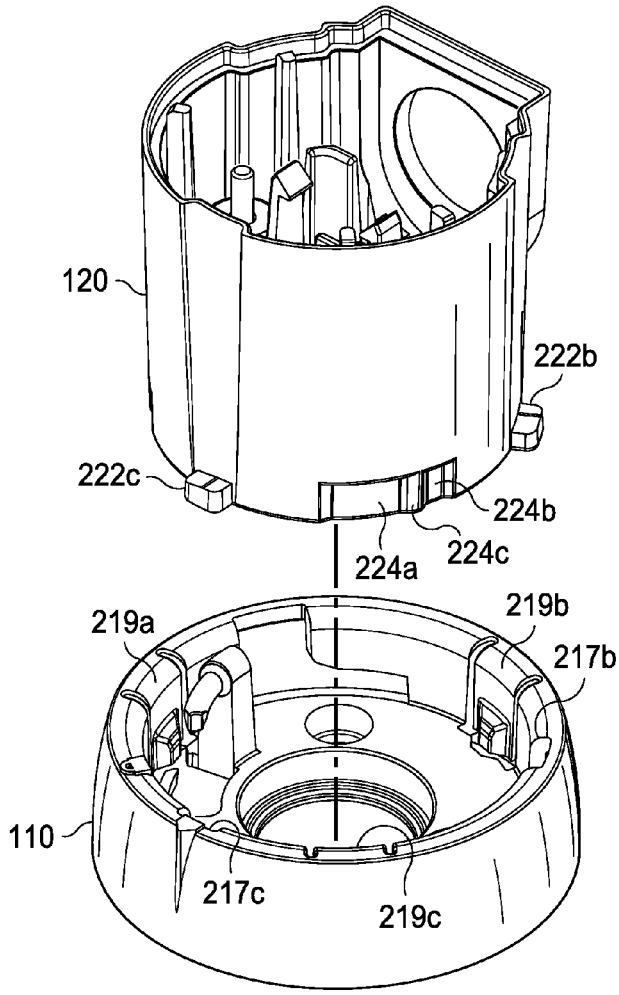
FIG. 6B illustrates an exploded side perspective view of the lamp holder base and the lamp holder housing.

Referring now to FIG. 6B, illustrated is an exploded side perspective view of the lamp holder base 110 and the lamp holder housing 120. Alignment lug 222*b* cooperates with longitudinal notch 217*b* in the same manner that alignment lug 222*c* cooperates with longitudinal notch 217*c* during insertion of the lamp holder housing 120 in the lamp holder base 110. Deflectable tab 219*c* will initially be positioned in the first detent 224*a* when the lamp holder housing 120 is inserted in the lamp holder base 110. When the lamp holder housing 120 is rotated in the lamp holder base 110, deflectable tabs 219*a*-219*c* deflect over ridge 224*c* and come to rest in second detent 224*b*.

Figure 7:
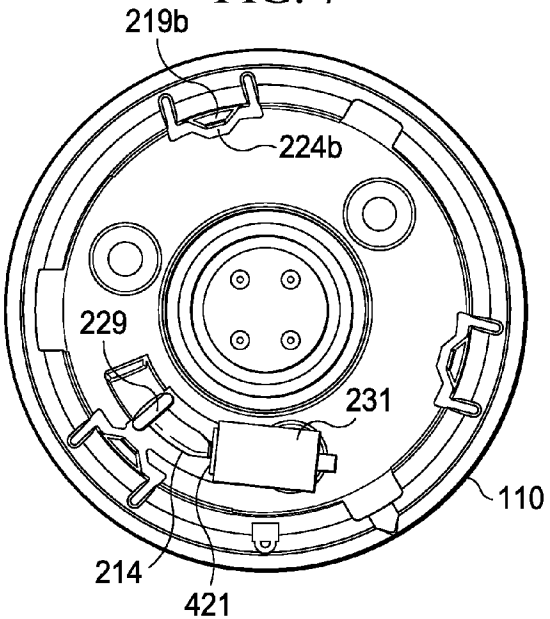
FIG. 7 illustrates a transparent view of the lamp holder housing locked in the lamp-receiving position to the lamp holder base.

Referring now to FIG. 7 with continuing reference to FIGS. 6A and 6B, illustrated is a transparent view of the lamp holder housing 120 locked in the lamp-receiving position to the lamp holder base 110. As can be seen, when the lamp holder housing 120 is rotated CW in the lamp holder base 110, deflectable tab 219*b* will then be positioned in the second detent 224*b*, effectively locking the lamp holder housing 120 to the lamp holder base 110 with the arcuate actuator finger 214 inserted through aperture 229 while simultaneously depressing the lever 421 of the microswitch 231. Of course, one who is skilled in the art will recognize that the other deflectable tabs 219*a*, 219*c* will be similarly positioned in second detents of their respective detents. Rotating the lamp holder housing 120 CCW with respect to the lamp holder base 110 will retract the arcuate actuator finger 214, release the lever 421, open the microswitch 231 and deactivate the electronic power supply of the ultraviolet lamp 150, thereby protecting the operator or technician.

It should be noted that the term "providing" as used herein includes: designing, forming, purchasing, etc., of the various parts of the lamp holder 100.

Although the present invention has been described in detail, those skilled in the art should understand that they can make various changes, substitutions and alterations herein without departing from the spirit and scope of the invention in its broadest form.

What is claimed is:

1. A lamp holder, comprising:

a lamp holder base having a longitudinal axis and an actuator finger coupled to and at least partially shielded within said lamp holder base;

a lamp holder housing removably coupleable to said lamp holder base; and a microswitch enclosed within said lamp holder housing, and wherein said microswitch is activated by said actuator finger when said lamp holder housing is inserted into and rotated with respect to said lamp holder base.

2. The lamp holder as recited in claim 1 wherein said lamp holder housing is rotatably coupleable to said lamp holder base.

3. The lamp holder as recited in claim 1 wherein said lamp holder housing has a first end having a well therein, said well configured to accommodate insertion of said actuator finger when said lamp holder housing is inserted into said lamp holder base.

4. The lamp holder as recited in claim 3 wherein said well comprises a radial wall having an aperture therethrough, said aperture configured to permit passage of at least a portion of said actuator finger through said radial wall.

5. The lamp holder as recited in claim 3 further comprising an alignment lug on said lamp holder housing proximate said first end, said alignment lug extending radially outward from a longitudinal axis of said lamp holder housing.

6. The lamp holder as recited in claim 5 further comprising an inner wall in said lamp holder base, said inner wall having a longitudinal notch configured to cooperate with said alignment lug when said lamp holder housing is inserted into said lamp holder base.

7. The lamp holder as recited in claim 6 further comprising a groove in said inner wall configured to cooperate with said alignment lug when said lamp holder housing is rotated in said lamp holder base.

8. The lamp holder as recited in claim 3 wherein said lamp holder has a twist lock mechanism comprising a deflectable tab on an inner wall of said lamp holder base and first and second detents in a periphery of said lamp holder housing proximate said first end, said deflectable tab and said first and second detents cooperating to lock said lamp holder housing to said lamp holder base against inadvertent separation.

9. The lamp holder as recited in claim 3 wherein said lamp holder housing has a second end having a non-removable cap thereon.

10. The lamp holder as recited in claim 1 further comprising a lamp socket removably coupleable to said lamp holder housing.

11. The lamp holder as recited in claim 10 wherein said lamp holder housing further comprises a guiding post and a holding clip coupled to said lamp holder housing, said guiding post configured to guide said lamp socket into a lamp-receiving position and said holding clip configured to resist movement of said lamp socket from said lamp-receiving position.

12. The lamp holder as recited in claim 1 wherein said lamp holder is configured to hold an ultraviolet lamp.

13. The lamp holder as recited in claim 1 wherein said lamp holder is configured to hold an ultraviolet C-band lamp.

14. A method of manufacturing a lamp holder, comprising:

providing a lamp holder base having a longitudinal axis and an actuator finger coupled to and at least partially shielded within said lamp holder base;

providing a lamp holder housing removably coupleable to said lamp holder base; and enclosing a microswitch within and coupled to said lamp holder housing, wherein said microswitch is activated by said actuator finger when said lamp holder housing is inserted into and rotated with respect to said lamp holder base.

15. The method as recited in claim 14 wherein providing a lamp holder housing includes providing a lamp holder housing that is rotatably coupleable to said lamp holder base.

16. The method as recited in claim 14 wherein providing a lamp holder housing includes providing a lamp holder housing having a first end having a well therein, said well configured to accommodate insertion of said actuator finger when said lamp holder housing is inserted into said lamp holder base.

17. The method as recited in claim 16 wherein providing a lamp holder housing includes providing a lamp holder housing wherein said well comprises a radial wall having an aperture therethrough, said aperture configured to permit passage of at least a portion of said actuator finger through said radial wall.

18. The method as recited in claim 16 further comprising forming an alignment lug on said lamp holder housing proximate said first end, said alignment lug extending radially outward from a longitudinal axis of said lamp holder housing.

19. The method as recited in claim 18 further comprising forming an inner wall in said lamp holder base, said inner wall having a longitudinal notch configured to cooperate with said alignment lug when said lamp holder housing is inserted into said lamp holder base.

20. The method as recited in claim 19 further comprising forming an arcuate groove in said inner wall configured to cooperate with said alignment lug when said lamp holder housing is rotated in said lamp holder base.

21. The method as recited in claim 16 wherein said lamp holder housing has a second end having a non-removable cap thereon.

22. The method as recited in claim 14 further comprising removably coupling a lamp socket to said lamp holder housing.

23. The method as recited in claim 22 wherein said lamp holder housing further comprises configuring a guiding post to guide said lamp socket into a lamp-receiving position and configuring a holding clip to resist movement of said lamp socket from said lamp-receiving position.

24. The method as recited in claim 14 wherein said lamp holder is configured to hold an ultraviolet lamp.

25. The method as recited in claim 14 wherein said lamp holder is configured to hold an ultraviolet C-band lamp.

* * * * *